United States Patent [19]

Schmitt et al.

[11] Patent Number: 4,913,751

[45] Date of Patent: Apr. 3, 1990

[54] HIGHER STRENGTH STEEL, ESPECIALLY REINFORCING STEEL OR DRAWING SHOP FEED STOCK WITH IMPROVED MATERIAL PROPERTIES AND IMPROVED PROCESSABILITY

[75] Inventors: Wolfgang Schmitt; Franz Tamm, both of Hennigsdorf; Gunter Lankau, Falkensee, all of German Democratic Rep.

[73] Assignee: VEB Stahl- und Walzwerk "Wilhelm Florin" , Hennigsdorf, German Democratic Rep.

[21] Appl. No.: 229,596

[22] Filed: Aug. 8, 1988

[30] Foreign Application Priority Data

Jan. 8, 1988 [DE] Fed. Rep. of Germany .... 3121210

[51] Int. Cl.[4] ..... C22C 33/00

[52] U.S. Cl. ..... 148/320; 148/902

[58] Field of Search ..... 148/902, 12 B, 32 D

[56] References Cited

U.S. PATENT DOCUMENTS 4,016,015 4/1977 Respen et al. ..... 148/902

4,146,411 3/1979 Dewsnap et al. ..... 148/902

FOREIGN PATENT DOCUMENTS 55-73849 6/1980 Japan ..... 148/902

*Primary Examiner*—Deborah Yee

*Attorney, Agent, or Firm*—Jordan and Hamburg

[57] ABSTRACT

An elongated steel element of enhanced strength suitable for use as reinforcement for concrete or drawing feed stock has a cross section which is heterogenous in structure and strength, the cross section comprising a core, a peripheral layer and a transition region between the core and the peripheral layer, the transition region consisting essentially of higher strength, harder martensite, the peripheral layer being of lower strength than the transition region and the core being of lower strength than the peripheral layer.

7 Claims, No Drawings

HIGHER STRENGTH STEEL, ESPECIALLY REINFORCING STEEL OR DRAWING SHOP FEED STOCK WITH IMPROVED MATERIAL PROPERTIES AND IMPROVED PROCESSABILITY

BACKGROUND OF THE INVENTION

The invention relates to a higher strength steel, in the dimensional range of small section and wire product lines, which, as final product, is intended preferably for use in concrete constructions and as a feed stock for drawing shops.

Alloying and technological possibilities for increasing the strength of reinforcing steels are limited primarily by the requirement that the physical properties be such, that these steels are thermally stable and can be welded extensively. Accordingly, conventionally produced, hard-rolled reinforcing steels correspond at most to Strength Class III, provided that there has been no additional microalloying.

At the carbon equivalent for steels that have not been micro alloyed and are suitable for welding, the production of reinforcing steels of Strength Class IV requires the use of additional process steps such as cold work-hardening or thermal work-hardening of the steel. Thermally work-hardened reinforcing steel of Strength Class IV with partial martensite transformation in a perpheral layer is still suitable universally for welding. The corresponding cold work-hardened reinforcing steel, on the other hand, only permits WP welding, since relaxation processes set in already at relatively low temperatures in cold work-hardened steels.

The known thermally work-hardened reinforcing steels have a ferritic-pearlitic core. Their peripheral layer comprises a high-strength martensitic layer of greater but lesser thermal stability than the core. The further processing steps of the reinforcing steel, moreover, such as bending and thread rolling, affect the strength of the peripheral layer. During the manufacture of such steels in wire rolling mills, problems with laying the coils naturally arise as a result of the work-hardened surface layer and the therewith associated greater stiffness of the wire.

A drawing shop feed stock, similar to the thermally work hardened reinforcing steels, is also known. In contrast to the conventional patenting, the drawing shop feed stock has a corresponding heat-treatment structure in the peripheral layer of its cross section (DE-C 23 45 738). However, to guaranty the drawability of the wire, the heat-treatment structure in the peripheral layer must not exceed 33% of the total cross section.

The invention is directed to enlarging the material- and technology-related boundaries that limit the increase in strength of higher-strength reinforcing steels and to improving the processability of reinforcing steel and the drawability of drawing stock feed stock with a heterogeneous structural constitution or to make the manufacture of such drawing stock in small-section steel mills possible.

SUMMARY OF THE INVENTION

According to the invention, there is provided a higher-strength steel, which has a heterogeneous structural constitution over its cross section which, when the steel is used as reinforcing steel, largely quarantees the suitability of the steel for welding and improves its reliability and processability and, when the steel is used as drawing shop feed stock, makes an improved drawability possible. Pursuant to the invention, these improvements are accomplished owing to the fact that the steel has a non-homogeneous distribution of strength over its cross section, there being a high-strength martensitic layer in the transition region between the peripheral layer of reduced strength and the softer core region. The structural constitution of this steel is characterized in that the peripheral layer, just as the layer of the high-strength transition region, largely comprises heat-treated martensite, the heat-treatment temperature of the peripheral layer corresponding at most to the $A_1$ temperature of the steel and thus being up to 350 deg. K. and preferably 50–250 deg. K. above the heat-treatment temperature of the high-strength martensitic layer of the transition region, and the core region comprising pearlite or ferrite and pearlite with some ferrite-pearlite intermediate.

On an area basis, the two martensitic layers together constitute, as a rule, no more than 50% of the total cross sectional area of the steel. Of this amount, the high-strength martensitic layer in the transition region occupies 5–95%.

An additional possibility for providing the cross section of the steel with a non-homogeneous strength distribution is given by developing the high-strength martensitic transition region from several martensitic layers with a heat-treatment temperature level falling off towards the core. Moreover, the structural constitution, in which the peripheral layer, similarly to the core, comprises ferrite and pearlite with ferrite-pearlite intermediate, is adjustable pursuant to the invention.

DETAILED DESCRIPTION OF A PREFERRED EMBODIMENT

An example of a higher-strength reinforcing steel and the method of making it according to the present invention is as follows.

| | |
|---|---|
| Chemical composition: | 0.24% C |
| | 0.45% Si |
| | 0.80% Mn |
| | 0.024% P |
| | 0.026% S |
| Dimensions: | rod balance Fe with a 25 mm diameter |

The structural constitution comprises a 1.2 mm thick martensitic peripheral layer, which has been heat treated at about 670° C. and has an $R_m$ of about 690 MPa, an adjoining, 1.8 mm thick transition layer having an $R_m$ of about 1,000 MPa, which has been heat treated at about 520° C., and a ferritic-pearlitic core region with an $R_m$ of about 590 MPa, this reinforcing steel having an overall tensile strength of 710 MPa.

We claim:

1. An elongated steel element of enhanced strength suitable for use as reinforcement for concrete or drawing feed stock, the steel having a cross section which is heterogeneous in structure and strength, the cross section comprising a core, a peripheral layer and a transition region between the core and the peripheral layer, the transition region consisting essentially of higher strength, harder martensite, the peripheral layer being of lower strength than the transition region and the core being of lower strength than the peripheral layer.

2. An elongated steel element according to claim 1, in which the peripheral layer consists essentially of a first heat treated martensite, the transition region consists essentially of at least a second heat treated martensite and the core consists essentially of ferrite or a combination of ferrite and pearlite with ferrite-pearlite intermediate, the first heat treated martensite having been heat treated at a temperature no higher than the $A_1$ temperature of the steel and the second heat treated martensite having been heat treated at a temperature up to 350° K. above the temperature at which the first heat treated martensite was heat treated.

3. An elongated steel element according to claim 2, in which the second heat treated martensite has been heat treated at a temperature of 50° to 250° K. above the temperature at which the first heat treated martensite has been heat treated.

4. An elongated steel element according to claim 3, in which the first and the second heat treated martensites constitute no more than half of the cross sectional area of the element.

5. An elongated steel element according to claim 4, in which the second heat treated martensite constitutes 5 to 95% of the cross sectional area of the element constituted of the first and the second heat treated martensite.

6. An elongated steel element according to claim 5, in which the peripheral layer consists essentially of ferrite or a combination of ferrite and pearlite with ferrite-pearlite intermediate.

7. An elongated steel element according to claim 6, in which the transition region consists of a plurality of different heat treated martensite layers, the layers differing as a result of the heat treatment temperature thereof decreasing with increasing proximity to the core.

* * * * *